US009895903B2

(12) United States Patent
Abergel et al.

(10) Patent No.: US 9,895,903 B2
(45) Date of Patent: Feb. 20, 2018

(54) METHOD AND SYSTEM FOR GILDING A SUBSTRATE

(71) Applicant: MGI Digital Technology, Fresnes (FR)

(72) Inventors: Edmond Abergel, Paris (FR); Raphael Renaud, Poitiers (FR)

(73) Assignee: MGI Digital Technology, Fresnes (FR)

( * ) Notice: Subject to any disclaimer, the term of this patent is extended or adjusted under 35 U.S.C. 154(b) by 0 days.

(21) Appl. No.: 15/126,118

(22) PCT Filed: Mar. 23, 2015

(86) PCT No.: PCT/EP2015/056122
§ 371 (c)(1),
(2) Date: Sep. 14, 2016

(87) PCT Pub. No.: WO2015/144637
PCT Pub. Date: Oct. 1, 2015

(65) Prior Publication Data

US 2017/0072711 A1 Mar. 16, 2017

(30) Foreign Application Priority Data

Mar. 24, 2014 (EP) ..... 14290076

(51) Int. Cl.
*B41J 11/00* (2006.01)
*B41F 19/00* (2006.01)
(Continued)

(52) U.S. Cl.
CPC ..... *B41J 11/0015* (2013.01); *B41F 19/00* (2013.01); *B41G 1/04* (2013.01); *B44C 1/14* (2013.01)

(58) Field of Classification Search
CPC ..... B41J 11/0015; B41J 11/002; B41J 31/06; B41G 1/04; B44C 1/14; B44C 1/145;
(Continued)

(56) References Cited

U.S. PATENT DOCUMENTS 4,651,756 A * 3/1987 Luke ..... A24C 5/583 131/284
4,724,026 A * 2/1988 Nelson ..... B32B 37/1284 101/32
(Continued)

FOREIGN PATENT DOCUMENTS

EP 0661177 A1 7/1995
WO 94/06624 A1 3/1994
(Continued)

OTHER PUBLICATIONS

International Search Report in PCT/EP2015/056122, dated Apr. 28, 2015, 7 pages, English translation attached.
(Continued)

*Primary Examiner* — Henok LeGesse
(74) *Attorney, Agent, or Firm* — Servilla Whitney LLC

(57) ABSTRACT

The invention relates to a method for the gilding of a substrate with the application of pressure between the zones of the substrate to be gilded and a gilding sheet comprising a gilding film and a transfer layer, characterized by the consecutive treatment of the gilded substrate, allowing the adhesion performance of the gilding sheet in relation to the substrate to be optimized while improving the visual quality of the gilding deposit on the substrate.

14 Claims, 2 Drawing Sheets

(51) Int. Cl.
*B44C 1/14* (2006.01)
*B41G 1/04* (2006.01)

(58) Field of Classification Search
CPC . B41M 1/22; B41M 7/02; B41M 7/00; B41M 7/008; B41M 7/0027; B41F 19/00
See application file for complete search history.

(56) References Cited

U.S. PATENT DOCUMENTS

| | | | | |
|---|---|---|---|---|
| 5,207,855 | A * | 5/1993 | Nyfeler | B41F 19/062 156/351 |
| 5,520,763 | A * | 5/1996 | Johnstone | B41M 5/398 156/233 |
| 2002/0054781 | A1 * | 5/2002 | Korem | B41J 3/4078 400/621 |

FOREIGN PATENT DOCUMENTS

| | | | |
|---|---|---|---|
| WO | 98/09815 | A1 | 3/1998 |
| WO | 2011110956 | A2 | 9/2011 |

OTHER PUBLICATIONS

Written Opinion in PCT/EP2015/056122, dated Apr. 28, 2015, 9 pages, English translation attached.

* cited by examiner

METHOD AND SYSTEM FOR GILDING A SUBSTRATE

CROSS REFERENCE TO RELATED APPLICATIONS

This is a National Phase entry of International Application No. PCT/EP2015/056122, filed Mar. 23, 2015, which claims priority to European Patent Application No. 14290076.0, filed Mar. 24, 2014, the disclosures of which are incorporated herein by reference in their entireties.

BACKGROUND OF THE INVENTION

This invention relates to the field of devices to customize substrates. Thus, the invention relates in particular to a method and/or a system to customize a substrate by depositing an additional coating (or material), commonly called "gilding" of a substrate. In particular, the invention specifically concerns a printing method comprising an ink jet printing step of a substrate followed by a "gilding" step by contact between the areas of the substrate to be gilded and a deposition device for "gilding" such as a gilding foil.

Techniques for gilding printed substrates are well known to those skilled in the art. The basic principle of this technique is based on the fact that depositing an additional coating (i.e., gilding or material) on the substrate, by a deposit "gilding" device, for example, by applying/pressing a foil (carrying said coating or gilding) on the selected areas of the substrate in such a way as to cause the portion desired of the foil to adhere to the selected areas of the substrate. For example, this technique may involve depositing the adhesive upon the substrate in a predetermined pattern before depositing the customized coating (for example, the gilding foil) on the adhesive deposited on the substrate. Depositing the adhesive may be performed using one or more techniques, such as for example inkjet printing, toner-based printing, silk-screening or offset printing.

This invention specifically concerns techniques of inkjet printing in relief, for example by means of piezoelectric printing heads, adapted according to the printing ink and/or varnish used.

The gilding foils used as part of this invention consist of several superposed films comprising by way of non-limiting example:

- one optional adhesive film,
- at least one gilding film,
- one optional protective film,
- one optional release film, and
- at least one transfer layer that allows transporting the gilding foil.

Various solutions for customization of substrate by gilding are known in the Prior Art and especially application No. WO2011110956 which, in its embodiment shown in its FIG. 2 describes a cold gilding system comprising a pressing system 200 and, upstream of this pressing system, a printing section comprising a printing device 210 (for example, an inkjet printer) for depositing a deposit pattern constituted by a layer of adhesive 222, onto a substrate 220. After pressing a foil sheet onto the substrate, the adhesive is hardened and becomes sticky, allowing the foil to adhere to the preset pattern. Pressing is performed by means of one or more pinch rollers (260) also called pressure rollers. This application of pressure is carried out on the entire gilding sheet.

Technique for gilding is typically optimized to promote better performance of the adherence of the gilding foil onto the substrate while improving the visual quality of the gilding deposited on the substrate. Despite the evolution and accuracy of gilding techniques, the Applicant has found it very difficult to reconcile these two conditions with known gilding techniques. One objective of this invention is therefore to provide a gilding technique which promotes better performance of the adherence of the gilding foil onto the substrate while improving the visual quality of the gilding deposited on the substrate.

BRIEF SUMMARY OF THE INVENTION

This invention aims to at least overcome this major drawback of the Prior Art.

This purpose is attained by a process for gilding a substrate by applying pressure between the areas of the substrate to be gilded and a gilding foil comprising a gilding film and a transfer layer characterized in that the application of pressure and the deposit of the gilding film is followed by pressure being applied to the areas of the substrate covered by the gilding film. This additional step which is consecutive to the application of pressure, is therefore carried out after separation of the gilding film from the transfer layer of the sheet.

DETAILED DESCRIPTION OF THE INVENTION

The application of pressure between the areas of the substrate to be gilded and a gilding foil comprising a gilding film and a transfer layer may be performed by any appropriate method. As an illustration, one may mention the use

Figure 1:
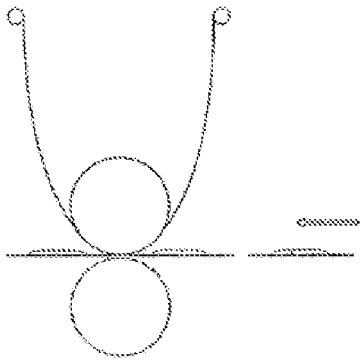
Prior Art Figure 1
FIGS. 1 and 2 illustrate a gilding technique in accordance with the Prior Art.
Figure 2:
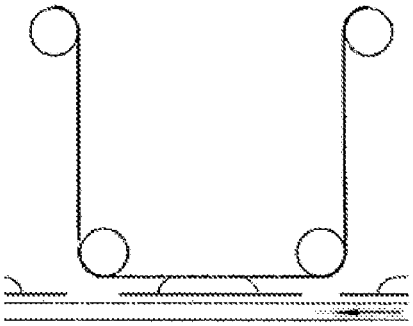
Prior Art Figure 2

- of one or more sets of pinch rollers such as described in FIG. 1;
- of one or more pressure rollers such as described in FIG. 2.

Then, when the gilding foil has been pressed against the substrate and the gilding film has been deposited on the substrate and thus detached from the transport layer, a second step to apply pressure on the substrate areas coated with the gilding film is performed by any suitable method. As an illustration, one may mention the use

- of one or more sets of pinch rollers such as described in FIG. 1;
- of one or more pressure rollers such as described in FIG. 2.

The fundamental advantage of this invention is that one may independently adjust the preferred set up parameters of the first application of pressure relative to those of the second pressure application step. The Applicant discovered in a surprising manner, that this optimizes both the performance of the adherence of the gilding film on the substrate while improving the visual quality of the gilding deposited on the substrate.

Figure 3:
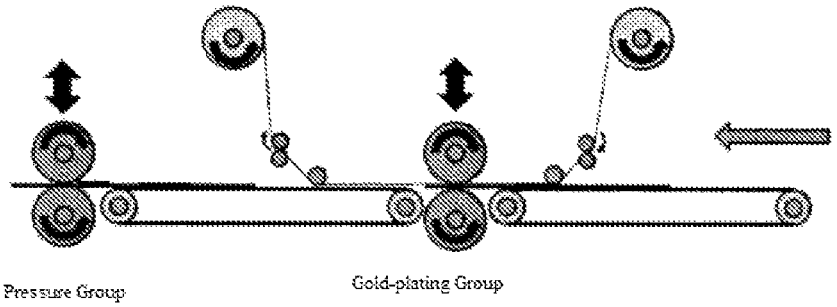
FIG. 3 illustrates a gilding technique according to a certain embodiment of this invention.

This invention is described in an illustrative manner and according to one of its embodiments in FIG. 3. On the left side of the Figure, a pressure group in accordance with this invention can be seen, which is downstream from the gilding group shown on the right side of Figure. The substrate is thus moved from right to left.

The pressure group is made up of a minimum of two motorized rollers, installed opposite each other, rotating in opposite directions, and whose distance is adjustable to adapt to the different thicknesses of the substrate; in accordance with a preferred embodiment of this invention, this adjustment not only takes into account the thickness of the substrate but also the thickness of the ink and/or varnish previously printed on the substrate and as an option, all of the thicknesses added to the substrate during the substrate processing steps preceding the gilding and also optionally, they may take into account the thickness of the films of the gilding foil deposited by the gilding group(s).

According to one particular embodiment of this invention, the distance between the opposing rollers can be motorized and controlled dynamically.

According to one particular and preferred embodiment of this invention, the surface of the upper roller is different from that of the lower roller; in particular, the surface of the upper roller is more compressible that that of the lower roller. As an illustration, the upper roller has a surface of compressible material allowing it to conform to the shape of the deposit of gilding while the lower roller is made of a harder material, for example, it is incompressible.

In accordance with one particular embodiment of this invention, the upper roller has a heating device that improves the adherence of the gilding; by way of example, this heating device may be advantageously used when the gilding film is coated with varnish because the heating softens said varnish.

In accordance with one particular embodiment of this invention, the pressure group works at a linear velocity (on the surface of the rollers) greater than or equal to that of gilding group so as not to slow down the machine.

In accordance with one particular embodiment of this invention, the distance between the gilding group and the pressure group is greater than the maximum length of the treated substrates.

One characteristic of this invention is that it makes it possible to perform a step to process the gilding film with the pressure group which controls this step independently from the deposition step which is controlled by the gilding group; this therefore optimizes both the performance of the adherence of the gilding film on the substrate while improving the visual quality of the gilding deposited on the substrate.

The control characteristics of the pressure group are given below for illustrative purposes: adjustable pressure (for example from 1 to 10 bar, preferably with operating pressures greater than 1 bar), and/or adjustable speed; and/or adjustable temperature (for example, a maximum operational temperature of 250° C., for example, between 50 and 240° C., preferably between 140 and 220° C., for example 180° C.); and/or a hardness of the upper roller coating of between 50 and 95 Shore A.

The improvement provided by this invention has been demonstrated in the laboratory by the applicant by tests carried out to evaluate the quality of the adherence of the gilding as well as making direct visual comparisons between various samples. The quality of the adherence of the gilding is performed with the "scotch tape" test: the gilding deposited was previously abraded with a cutter, a piece of scotch tape is pressed on the gilding and then quickly pulled off; if the adhesive does not pull the gilding off, its adherence is considered satisfactory.

The substrate may be selected from a large number of materials and should not be considered limited to materials frequently used in standard printing and/or customization devices such as paper, cardboard and plastic substrates. Non-limiting examples may be mentioned such as metal, paper, nonwoven fabric, plastic, for example a methacrylic copolymer resin, polyester, polycarbonate, polyethylene, polypropylene, polystyrene and/or polyvinyl chloride, or even cellulosic type materials such as, for example, wood, plywood, or crystalline materials such as glass or ceramics, for example. The invention therefore applies also to any combination of these materials, such as complex materials comprising one or more of these components such as milk cartons.

According to this invention, the substrate (foil, card, etc . . . ) is generally in a rectangular or square shape. This sheet moves, usually via a substrate transport system in a printing machine, along a transport path oriented along a longitudinal axis from at least one input store for supplying the printable and/or customizable substrates, to at least one outlet store receiving the printed and/or customized substrates. The "lateral edges" of the substrate are the two edges located on either side of this longitudinal axis; the front and/or rear edges are its transverse edges.

This invention relates to a gilding method and/or a gilding system. This invention also relates to a printing method and/or system comprising a gilding of a substrate. Any gilding technique suited to the method of this invention may be used. However, in accordance with some preferred embodiments of this invention, the cold foil technique, also known as "cold foil transfer", is used.

Thus, according to some embodiments of the present invention, a gilding foil (which is therefore part of the gilding device) is pressed against the printed areas of the substrate that require the deposition of said foil. This contact between the gilding foil and the substrate is generally carried out by means of two rollers between which the substrate and the gilding foil are brought into contact.

To ensure optimum detachment of the gilding film and its adherence to the areas of the printed substrate, an adhesive is preferably used. This adhesive can either be positioned on the printed areas (before applying the gilding), or form part of the gilding foil itself. In some embodiments adapted to this invention, a gilding foil is used which incorporates an adhesive film (which will be pressed against the areas to be gilded) to which an adhesive has been previously applied (the same or different) on the printed areas (prior to application of the gilding). In other embodiments of this invention, an ink and/or varnish used for printing already confer an adhesive property to the areas to be covered with gilding; the latter option is particularly advantageous because it avoids having to use additional adhesive on the areas to be gilded and/or it allows using gilding foil free of adhesive film.

Lastly, according to certain embodiments of this invention, the gilding technique may also include an activation step (for example, the use of UV light) making it possible to crosslink the ink and/or varnish and/or the adhesive and thus improve the adherence between the gilding foil and the areas in relief of the substrate.

It is obvious to the professional in the field that the words "gilding" and "gild" used in the present invention are not limited to the use of gold leaf and that any "gilding" device can be used. Of course, these terms cover all types of decorative foils (sometimes also called metal foils) among which may be mentioned by way of an illustrative and non-restrictive example, aluminum, chromium, gold, silver, copper or even optically active metal salts. In general, it is customary to use a gilding foil pressed against the substrate to customize, and therefore, this application uses this general term to denote the use of a gilding device.

Gilding foils used in the context of this invention are generally supplied in the form of rolls having a width which is substantially equivalent to the cross-sectional dimension of the substrate.

The gilding foils used in the context of this invention are generally comprised of several superposed films. By way of a non-limiting and non-exhaustive example, we may mention, in the order of attachment to the substrate to be gilded:

- an adhesive film (optional but preferred). This film may include any type of resin and/or wax and/or filler and can also transit to a sticky state under the effect of heat treatment. Its thickness is generally between 0.5 and 5 microns; and/or
- at least one gilding film, and
- a protective film (optional but preferred) also called lacquering and/or colored (which can also include any type of dye and/or pigment and/or matte or glossing agent). This protective film can be characterized by many properties depending on the intended use, whether they are chemical and/or physical resistance properties; and or
- a separation film (optional but preferred) also called release ("release layer"). This film is usually very thin (usually of a thickness less than 0.1 micron) and for example, it may be formed from solvent soluble resins and/or waxes; and/or
- one transfer layer that allows transporting the gilding sheet. This layer has a thickness which is generally between 5 and 50 microns. It is generally made up of polyester films.

The printing method according to this invention, generally concerns inkjet printing in relief of a substrate in the areas to be covered by a gilding foil. Inkjet printing is well known to the professional in the art.

The areas may be of any form, for example dots, letters and/or any other geometric forms whatsoever. They may be made up of different materials, for example inks and/or varnishes. They may also be coated with a layer of material, for example, coated with adhesive, before the gilding step; however, according to certain embodiments of this invention, the gilding step is performed directly onto the ink and/or varnish deposited by the ink jet.

The relief of said areas destined to be covered by a gilding sheet preferably represents the thickness of around one micron, preferably greater than five microns, or even greater than ten microns. This thickness—of any material that has been previously deposited upon the substrate; for example, varnish and/or ink—is generally lower than one millimeter by printing in relief. However, this invention may also be of application for substrates having been printed by 3D technology, using ink (and/or varnish) jet printing in successive layers and thus having thicknesses of up to several centimeters, for example less than 2 cm.

It is understood from the foregoing that this invention also relates to at least one printing and/or customization device (or system) comprising means to implement at least one of the methods described in this application. With the functional considerations given in this application, we understand that such systems or devices include a means to perform the functions described in reference to the method and that it is not necessary to describe these means in greater detail.

This application describes various technical features and advantages with reference to the figures and/or various embodiments. The expert will understand that the technical characteristics of a given embodiment may in fact be combined with the characteristics of another embodiment unless the opposite is explicitly mentioned or if it is clear that these characteristics are incompatible or that the combination does not provide a solution to at least one of the technical problems mentioned in this application. In addition, the technical characteristics described in a given embodiment may be isolated from the other characteristics of this mode unless the opposite is explicitly mentioned.

It should be obvious to those skilled in the art that this invention allows embodiments in many other specific forms without departing from the scope of the invention as claimed. Consequently, these embodiments must be considered to be for illustrative purposes being able to be modified within the domain defined by the scope of the attached Claims, and the invention should not be limited to the details given above.

The invention claimed is:

1. A method for gilding a substrate comprising:

a) in a first step, pressing a gilding foil against the substrate, wherein the gilding foil comprises a gilding film attached to a transfer layer, and pressing the gilding foil against the substrate detaches the gilding film from the transfer layer and deposits the gilding film on the substrate, and b) in a second, subsequent step, applying pressure to areas of the substrate covered by the deposited gilding film, wherein the pressure applied in the second step is independently adjustable relative to pressure applied in the first step.

2. The method according to claim 1 wherein the gilding foil comprises at least one gilding film, at least one transfer layer and a release film.

3. The method according to claim 2, wherein the gilding foil further comprises an adhesive film.

4. The method according to claim 2, wherein the gilding foil further comprises a protective film.

5. The method according to claim 1 characterized in that the pressure applied in the second step falls between 1 and 10 bars.

6. The method according to claim 1, wherein the pressure applied in the second step is applied by pinch rollers, and wherein an upper roller increases the temperature of the gilding film.

7. The method according to claim 6 wherein the temperature is adjustable and is between 50 and 240° C.

8. The method according to claim 1, further comprising an ink jet printing step that prints in relief on areas on the substrate, and the areas printed in relief are coated with the gilding film.

9. The method according to claim 8 wherein the areas printed in relief have a thickness greater than one micron.

10. A system for gilding a substrate comprising at least one gilding group which applies pressure between areas of the substrate to be gilded and a gilding foil comprising a gilding film and a transport layer, thereby coating the gilding film on the substrate, and at least one pressure group located downstream of the gilding group which applies pressure on areas of the substrate coated with the gilding film, wherein, the pressure applied by the at least one pressure group is independently adjustable relative to the pressure applied by the at least one gilding group.

11. The system according to claim 10 wherein the at least one pressure group is made up of a minimum of two motorized rollers, installed opposite each other, rotating in opposite directions, and whose distance is adjustable to adapt to different thicknesses of the substrate.

12. The system according to claim 11, wherein the pressure group comprises a heating device, said heating device being integrated into an upper motorized roller.

13. The system according to claim 11, wherein an upper roller has a hardness between 50 and 95 Shore A.

14. The system according to claim 10, further comprising an ink jet printing group which prints in relief on the substrate by means of ink and/or varnish prior to application of pressure by the gilding group.

* * * * *